US009596904B2

(12) United States Patent
Bishop et al.

(10) Patent No.: US 9,596,904 B2
(45) Date of Patent: Mar. 21, 2017

(54) STRAP SYSTEMS FOR ARTICLES OF FOOTWEAR AND OTHER FOOT-RECEIVING DEVICES

(75) Inventors: Jennifer Bishop, Beaverton, OR (US); John Hurd, Lake Oswego, OR (US); Matthew A. Nurse, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 1101 days.

(21) Appl. No.: 13/431,115

(22) Filed: Mar. 27, 2012

(65) Prior Publication Data

US 2013/0255105 A1 Oct. 3, 2013

(51) Int. Cl.

| | |
|---|---|
| ***A43C 11/00*** | (2006.01) |
| ***A43B 13/00*** | (2006.01) |
| ***A43B 7/14*** | (2006.01) |
| ***A43B 3/12*** | (2006.01) |
| *A43C 1/00* | (2006.01) |

(52) U.S. Cl.

CPC ..... *A43B 3/126* (2013.01); *A43C 11/00* (2013.01); *A43C 1/00* (2013.01); *A43C 11/004* (2013.01); *A43C 11/008* (2013.01)

(58) Field of Classification Search

CPC A43B 3/126; A43C 1/00; A43C 11/00; A43C 9/00

USPC ..... 36/50.1, 5, 114, 115, 88, 93

See application file for complete search history.

(56) References Cited

U.S. PATENT DOCUMENTS

| | | | | |
|---|---|---|---|---|
| 259,273 | A * | 6/1882 | Smith | A63D 15/12 473/49 |
| 726,776 | A * | 4/1903 | Smith | C09J 189/00 106/137.7 |
| 1,032,600 | A | 7/1912 | Grout | |
| D100,767 | S * | 8/1936 | Gerton | D2/918 |

(Continued)

FOREIGN PATENT DOCUMENTS

| | | |
|---|---|---|
| FR | 1111959 A | 3/1956 |
| WO | 9004933 | 5/1990 |
| WO | 2008012825 | 1/2008 |

OTHER PUBLICATIONS

International Searching Authority, "International Search Report and Written Opinion," issued in connection with international application serial No. PCT/US2013/033705, mailed Jun. 19, 2013, 13 pages.

(Continued)

*Primary Examiner* — Jila M Mohandesi

(74) *Attorney, Agent, or Firm* — Banner & Witcoff, Ltd.

(57) ABSTRACT

Strap systems for securing feet into articles of footwear or other foot-receiving devices include one or more strap members formed or engaged together in a continuous path along an upper for an article of footwear or other foot-receiving device. One or more structures for applying a force to the strap member(s) is provided so as to shorten a length of the continuous path and thereby apply tension to the strap member(s). Such strap systems can be arranged so that the strap tightens during plantar flexion or dorsiflexion. Additional aspects of this invention relate to bootie members for supporting such strap systems, upper members or bootie members including such strap systems, and articles of footwear and other foot-receiving devices including such strap systems.

29 Claims, 9 Drawing Sheets

(56) References Cited

U.S. PATENT DOCUMENTS

| | | | | | |
|---|---|---|---|---|---|
| 2,112,884 | A * | 4/1938 | Gillette | A43B 3/126 | 12/142 S |
| 2,126,094 | A * | 8/1938 | Daniels | A43B 3/122 | 36/11.5 |
| 2,259,273 | A * | 10/1941 | Smith | 36/11.5 | |
| 3,516,181 | A | 6/1970 | Jordan | | |
| 4,200,997 | A * | 5/1980 | Scheinhaus | A43C 11/1493 | 36/11.5 |
| 4,446,633 | A * | 5/1984 | Scheinhaus | A43B 3/126 | 36/11.5 |
| 5,819,439 | A * | 10/1998 | Sanchez | 36/89 | |
| 6,021,585 | A * | 2/2000 | Cole | 36/11.5 | |
| 6,637,130 | B2 * | 10/2003 | Urie et al. | 36/11.5 | |
| 6,772,541 | B1 * | 8/2004 | Ritter et al. | 36/88 | |
| 7,103,993 | B2 * | 9/2006 | Sakai | A43B 3/122 | 36/11.5 |
| 7,272,897 | B2 * | 9/2007 | Yu | 36/11.5 | |
| D683,112 | S * | 5/2013 | James | D2/896 | |

OTHER PUBLICATIONS

Mar. 14, 2016—(CN) Office Action—App 201380016473.4.

* cited by examiner

STRAP SYSTEMS FOR ARTICLES OF FOOTWEAR AND OTHER FOOT-RECEIVING DEVICES

FIELD OF THE INVENTION

This invention relates generally to strap systems for securing feet into articles of footwear or other foot-receiving devices, as well as to bootie members for supporting such strap systems, upper members or bootie members including such strap systems, and articles of footwear and/or other foot-receiving devices including such strap systems.

BACKGROUND

Most articles of footwear include laces, buckles, or zippers to close off the foot-receiving opening of the shoe and/or to secure the shoe to the wearer's foot. While adequate for many uses, these systems are relatively static. These systems do little or nothing to help a shoe conform to a wearer's foot and to changes in the size, shape, and/or volume of various portions of the wearer's foot as the wearer moves while wearing the shoe. Better conformance of a shoe to a wearer's foot through more or throughout all phases of use (e.g., throughout the step cycle, while jumping, while cutting, while in plantar flexion, while in dorsiflexion, etc.) can provide a more stable and comfortable feel for the wearer. The deficiencies of the above-noted static systems are further exacerbated for users involved in athletic activities because such activities tend to place great stress on the foot and can cause portions of the foot to undergo significant changes in size, shape, volume, and/or motion.

Accordingly, there is room in the art for improvements in securing systems for engaging footwear or other foot-receiving devices with a wearer's foot, and particularly in athletic footwear.

SUMMARY

The following presents a general summary of aspects of this invention in order to provide a basic understanding of the invention. This summary is not intended as an extensive overview of the invention. It is not intended to identify key or critical elements of the invention or to delineate the scope of the invention. The following summary merely presents some concepts relating to the invention in a general form as a prelude to the more detailed description that follows.

Aspects of this invention relate to strap systems for securing feet into articles of footwear or other foot-receiving devices, as well as to bootie members for supporting such strap systems, upper members or bootie members including such strap systems, and articles of footwear or other foot-receiving devices including such strap systems. Such strap systems may include: (a) one or more strap members formed or engaged together in a continuous path along an upper for an article of footwear or other foot-receiving device, (b) means for applying a force to the one or more strap members so as to shorten a length of the continuous path and thereby apply tension to the one or more strap members (and to apply a compressive force to a foot within the foot-receiving device), and/or (c) structures for securing the strap member(s) to an upper or a bootie member in selective locations so as to correctly, reliably, and repeatably position the strap member(s) to achieve the desired results.

At least some aspects of this invention relate to motion activated performance systems as support systems for the foot (e.g., as part of an article of footwear or other foot-receiving device) that adapt fit/support instantaneously to changing foot volume and/or other foot dimensions through a full foot gait or step cycle or other activities (e.g., jumping, starting from blocks, etc.). Such strap systems may utilize a change in volume/length of the foot and ankle during motion to facilitate shoe conformance to the varying shape of the foot. As a wearer's ankle goes through plantar flexion and/or dorsiflexion of a normal gait, running, and even cutting or other activities, the strap system may be tightened, leading to dynamic conformance of the shoe to the foot even as the foot changes shape.

Additional aspects of this invention relate to methods for making strap systems, bootie members, upper members, articles of footwear, and/or other foot-receiving devices of the types generally described above.

BRIEF DESCRIPTION OF THE DRAWINGS

A more complete understanding of the present invention and certain advantages thereof may be acquired by referring to the following detailed description in consideration with the accompanying drawings, in which the same reference numbers indicate the same or similar features throughout, and wherein.

DETAILED DESCRIPTION

Figure 1A:
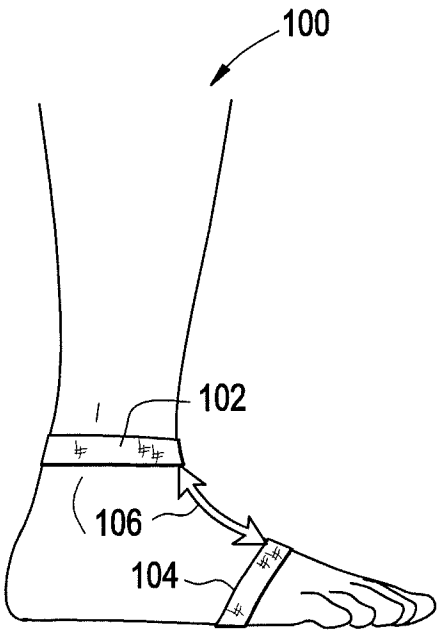
FIGS. 1A through 1C illustrate various foot positions and motions and provide background and context for various portions of the detailed description that follows.

In the following description of various example strap systems, bootie members, uppers, footwear, and other foot-receiving devices, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures and/or the orientations during typical use or while standing upright. Nothing in this specification should be construed as requiring a specific three dimensional orientation of structures in order to fall within the scope of this invention.

To assist and clarify the subsequent description of various embodiments of this invention, various terms are defined herein. Unless otherwise indicated or clear from the context, the following definitions apply throughout this specification (including the claims). "Shoe" and "article of footwear" are used interchangeably to refer to articles intended for wear on a human foot. A "shoe" may or may not enclose the entire foot of a wearer. For example, a "shoe" could include a sandal or other article that exposes large portions of a wearing foot. Aspects of this invention may be practiced on any desired type of shoe, including but not limited to: all types of shoes, boots, sneakers, sandals, thongs, flip-flops, mules, scuffs, slippers, sport-specific shoes (such as golf shoes, basketball shoes, running shoes, cross training shoes, tennis shoes, baseball cleats, soccer or football cleats, ski boots, etc.), and the like. "Footwear" or "shoes" may protect the feet from the environment and/or enhance a wearer's performance (e.g., physically, physiologically, medically, etc.).

The "interior" of a shoe refers to the space that is occupied by a wearer's foot when the shoe is worn. An "inner" side or face of a shoe element refers to a side or face of that element that is (or will be) oriented toward the shoe interior in a completed shoe when the shoe is fastened to a wearer's foot. An "outer" side or face of an element refers to a side or face that is (or will be) oriented away from the shoe interior in the completed shoe when the shoe is fastened to a wearer's foot. In some cases, an inner side/face of an element may have other elements between it and the interior in the completed shoe. Similarly, an outer side/face of an element may have other elements between it and the space external to the completed shoe.

Certain regions of a shoe or any portion thereof also may be described herein by reference to the anatomical structures of a human foot wearing a shoe that is properly sized for that foot. One or more of the below-defined regions may overlap. A "forefoot" region will generally cover and/or support the metatarsal and phalangeal bones of the wearer's foot and will extend beyond the wearer's toes to the frontmost portion of the shoe. A "midfoot" region will generally cover and/or support the cuboid, navicular, medial cuneiform, intermediate cuneiform, and lateral cuneiform bones of the wearer's foot. A "hindfoot" or "heel" region extends from the midfoot region to the rearmost portion of the shoe and covers and/or supports the wearer's heel. The hindfoot region may cover the sides of the calcaneous bone of a wearer and may, depending on a particular shoe configuration, cover some or all of the wearer's talus bone (ankle).

In addition to articles of footwear, aspects of this invention can be practiced with other types of "foot-receiving devices" (i.e., any device into which a user places at least some portion of his or her foot). In addition to all types of "footwear" or "shoes" (e.g., as described above), "foot-receiving devices" include, but are not limited to: boots, bindings and other devices for securing feet in snow skis, cross country skis, water skis, snowboards, and the like; boots, bindings, clips, or other devices for securing feet in pedals for use with bicycles, exercise equipment, and the like; boots, bindings, clips, or other devices for receiving feet during play of video games or other games; and the like. Such foot-receiving devices may include: (a) a foot-covering component (akin to a footwear upper, and may be used interchangeably with the term "upper") that at least in part defines an interior chamber for receiving a foot; and (b) a foot-supporting component (akin to the footwear sole structure) engaged with the foot-covering component. Strap systems as described above may be incorporated into the foot-covering component (or upper) and/or foot-supporting component of any desired type of foot-receiving device.

At least some example aspects of this invention relate to strap systems for articles of footwear and other foot-receiving devices, as well as to methods of making such structures. A general description of aspects of the invention followed by a more detailed description of specific examples of the invention follows.

A. General Description of Strap Systems, Bootie Members, Uppers, Articles of Footwear, and other Foot-Receiving Devices According to Aspects of the Invention, as well as Methods of Making the Same In general, some aspects of this invention relate to strap systems for securing feet into articles of footwear or other foot-receiving devices. Such strap systems may include: one or more strap members formed or engaged together in a continuous path along an upper for an article of footwear or other foot-receiving device and means for applying a force to the one or more strap members so as to shorten a length of the continuous path and thereby apply tension to the one or more strap members (and to the underlying foot). Various examples of the means for applying a force will be described in more detail below.

As some more specific examples, the continuous path of one strap system may include: (a) a first strap portion extending along a lateral ankle opening area, (b) a second strap portion extending from the first strap portion and across a front of the ankle opening area, (c) a third strap portion extending from the second strap portion and around a medial midfoot area, (d) a fourth strap portion extending from the third strap portion and beneath a plantar surface area, (e) a fifth strap portion extending from the fourth strap portion and around a lateral side area at or near a fifth metatarsal head area, (f) a sixth strap portion extending from the fifth strap portion and across a top forefoot area, (g) a seventh strap portion extending from the sixth strap portion and around a medial side area at or near a first metatarsal head area, (h) an eighth strap portion extending from the seventh strap portion and beneath the plantar surface area, (i) a ninth strap portion extending from the eighth strap portion and across the front of the ankle opening area, and (j) a tenth strap portion extending from the ninth strap portion and along a medial ankle opening area. The strap system further may include a means for applying a force to the one or more strap members so as to shorten a length of the continuous path and thereby apply tension to the one or more strap members (and to the underlying foot). If desired, this type of strapping system may be formed from two (or more) independent strap members as a continuous loop around the upper and engaged with the upper (e.g., a bootie element) in a free floating manner Straps of this type may be arranged to provide tightening during plantar flexion or during a plantar flexion stage of a step cycle or other action.

One more specific example of this type of strap system includes: (a) a first strap member having a first end and a second end, the first strap member extending from a first metatarsal head area, beneath a plantar surface area, over a lateral midfoot area, across a front instep area, around a medial ankle opening area, around a rear ankle opening area, along a lateral ankle opening area, and across the front instep area; and (b) a second strap member having a first end and a second end, the second strap member extending from a medial midfoot area, beneath the plantar surface area, around the fifth metatarsal head area, across a top forefoot area, and toward the first metatarsal head area, wherein the first end of the first strap member engages the second strap member, and wherein the first strap member engages the first end of the second strap member.

As another example, strap systems in accordance with some examples of this invention may include in a continuous path: (a) a first strap portion fixed with or beneath a footbed of an upper at a forefoot area, wherein the first strap portion extends around a lateral forefoot or midfoot edge, (b) a second strap portion extending from the first strap portion and across an instep area, (c) a third strap portion extending from the second strap portion and around a medial ankle area, (d) a fourth strap portion extending from the third strap portion and around a rear ankle area, (e) a fifth strap portion extending from the fourth strap portion and along a lateral ankle area, (f) a sixth strap portion extending from the fifth strap portion and across the instep area, and (g) a seventh strap portion extending from the sixth strap portion and around a medial midfoot edge, wherein the seventh strap portion is fixed with or beneath the footbed at a midfoot area. This strap system also may include a means for applying a force to the one or more strap members so as to shorten a length of the continuous path and thereby apply tension to the one or more strap members (and to the underlying foot). If desired, this type of strap system may be formed from two (or more) independent strap members. Straps of this type also may be arranged to provide tightening during plantar flexion or during a plantar flexion stage of a step cycle.

One more specific example of an upper having this type of strap system includes: (a) a bootie element (or other upper component) at least partially defining a foot-receiving chamber, wherein the upper includes a footbed for supporting a wearer's foot; (b) a first strap member having a first end fixed with or beneath the footbed at a forefoot portion of the upper, wherein the first strap member extends around a lateral forefoot or midfoot edge of the upper, across an instep area of the upper, around a medial ankle opening area of the upper, and around a rear ankle opening area of the upper; and (c) a second strap member having a first end fixed with or beneath the footbed at a midfoot portion of the upper, wherein the second strap member extends around a medial midfoot edge of the upper, across the instep area of the upper, and to a lateral ankle opening area of the upper, wherein the first strap member engages the second strap member at the lateral ankle opening area.

Another example strap system for an article of footwear or other foot-receiving device includes one or more strap members formed or engaged together in a continuous path along an upper for an article of footwear or other foot-receiving device that include: (a) a first strap portion extending around a front ankle opening area, (b) a second strap portion extending from the first strap portion and along a lateral ankle opening area, (c) a third strap portion extending from the second strap portion and around a rear ankle opening area, (d) a fourth strap portion extending from the third strap portion and along a medial heel area, (e) a fifth strap portion extending from the fourth strap portion and around a medial edge, (f) a sixth strap portion extending from the fifth strap portion and across a plantar surface area, (g) a seventh strap portion extending from the sixth strap portion and around a lateral edge area, (h) an eighth strap portion extending from the seventh strap portion and across a top area, (i) a ninth strap portion extending from the eighth strap portion and around the medial side area at or near a first metatarsal head area, (j) a tenth strap portion extending from the ninth strap portion and beneath the plantar surface area, (k) an eleventh strap portion extending from the tenth strap portion and around the lateral side area at or near the fifth metatarsal head area, (l) a twelfth strap portion extending from the eleventh strap portion and across the top area, (m) a thirteenth strap portion extending from the twelfth strap portion and around the medial edge area, (n) a fourteenth strap portion extending from the thirteenth strap portion and across the plantar surface area, (o) a fifteenth strap portion extending from the fourteenth strap portion and around the lateral edge area, (p) a sixteenth strap portion extending from the fifteenth strap portion and along a lateral heel area, (q) a seventeenth strap portion extending from the sixteenth strap portion and around the rear ankle opening area, and (r) an eighteenth strap portion extending from the seventeenth strap portion and along the medial ankle opening area. The strap system further may include a means for applying a force to the one or more strap members so as to shorten a length of the continuous path and thereby apply tension to the one or more strap members (and to the underlying foot). Such strap systems may be arranged to tighten as the foot moves from plantar flexion to dorsiflexion (e.g., which may be particularly useful when the plantar flexed position of the foot is optimal, such as when sprinting).

Strap systems in accordance with at least some examples of this invention further may include ankle securing strap portions that extend downward from the ankle opening area (e.g., on the medial and/or lateral sides thereof) and beneath a plantar surface or footbed of the upper. These additional strap portions may be secured to the upper beneath the footbed or to an underside of the footbed. These ankle securing strap portions can help lock down the ankle with respect to the upper.

Additional aspects of this invention relate to bootie members to which strap systems of the types described above may be engaged. As a more specific example, such bootie members may include: (a) a bootie component at least partially defining a foot-receiving chamber accessible through an ankle opening provided in the bootie component; (b) a first loop element engaged with or formed in a medial side edge area of the bootie component; (c) a second loop element engaged with or formed in the medial side edge area of the bootie component and located longitudinally rearward from the first loop element; (d) a third loop element engaged with or formed in a lateral side edge area of the bootie component; and (e) a fourth loop element engaged with or formed in the lateral side edge area of the bootie component and located longitudinally rearward from the third loop element. Another example bootie member may include: (a) a bootie component at least partially defining a foot-receiving chamber accessible through an ankle opening provided in the bootie component; (b) a first loop element engaged with or formed in a medial side edge area of the bootie component at a mid-heel area; (c) a second loop element engaged with or formed in the medial side edge area of the bootie component and located longitudinally forward from the first loop element in a midfoot area; (d) a third loop element engaged with or formed in the medial side edge area of the bootie component and located longitudinally forward from the second loop element at or near a first metatarsal head area; (e) a fourth loop element engaged with or formed in a lateral side edge area of the bootie component at the mid-heel area; (f) a fifth loop element engaged with or formed in the lateral side edge area of the bootie component and located longitudinally forward from the fourth loop element in the midfoot area; and (g) a sixth loop element engaged with or formed in the lateral side edge area of the bootie component and located longitudinally forward from the fifth loop element at or near a fifth metatarsal head area. Loop elements of this type also may be provided with an upper member or component that does not include an entire bootie member or bootie component, as described above.

Each of the noted loop elements may extend substantially along a longitudinal direction of the bootie member or upper member so as to define a strap receiving opening oriented in a direction offset from the longitudinal direction (e.g., oriented to receive a strap as it transitions between an upper surface and a bottom surface of the bootie or upper member). If desired, at least some of these loop elements may be located at an edge of the bootie member, e.g., at a junction of an upper bootie portion and a footbed or foot supporting member. Additionally, or alternatively, if desired, the bootie or upper members described above further may include a loop element engaged with or formed in a rear portion of the bootie or upper component adjacent the ankle opening.

Additional aspects of this invention relate to uppers for articles of footwear or other foot-receiving devices that include strap systems and/or bootie members of the types described above. The strap systems may be engaged with the uppers in any desired manner without departing from this invention including with the use of any desired type of engagement structures. In some examples, the one or more strap members of the strap systems will be engaged by threading the strap member(s) through one or more loop elements provided at various locations around the bootie member or other upper construction.

Still additional aspects of this invention relate to articles of footwear or other foot-receiving devices that include uppers, bootie members, and/or strap systems of the various types described above. Such articles of footwear or other foot-receiving devices may include a sole member or other type of foot-supporting member engaged with the upper, the bootie member, and/or the strap system. The strap member(s) also may extend between layers of the sole member or other foot-supporting devices, e.g., through a channel or gap provided within such structures so as to allow free floating engagement, if desired.

Finally, additional aspects of this invention relate to methods of making the various articles or components described above. Such methods may include one or more of: (a) engaging one or more strap members of the types described above together in a continuous path along an upper for an article of footwear or other foot-receiving device; (b) engaging or otherwise providing a means for applying a force with the one or more strap members, wherein the means for applying the force shortens a length of the continuous path to thereby apply tension to the one or more strap members (and to the underlying foot); and/or (c) engaging a sole member or other foot-supporting member with the upper to thereby form an article of footwear or other foot-receiving device. When the strap system includes two or more strap members, these strap members may be appropriately engaged with one another so that a force can be applied to the strap members to shorten the continuous path (and thus tighten the strap members on the wearer's foot).

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of strap systems, bootie members, upper members, articles of footwear, and/or other foot-receiving devices, as well as to methods for making these structures, in accordance with examples of this invention. When the same reference number appears in more than one drawing, that reference number is used consistently in this specification and the drawings to refer to the same or similar parts throughout.

Figure 1B:
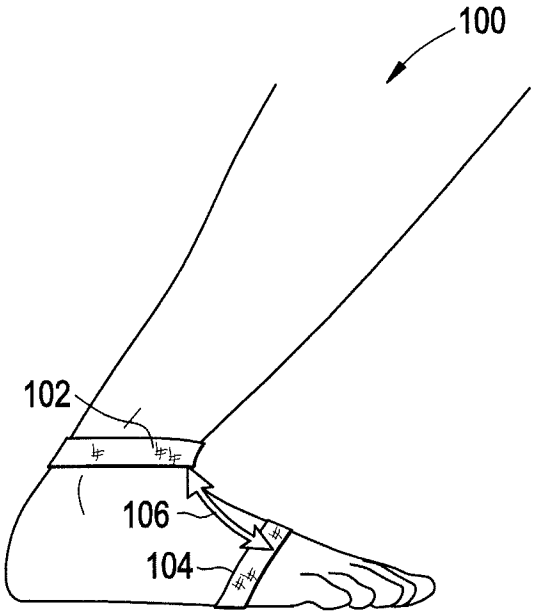
Figure 1C:
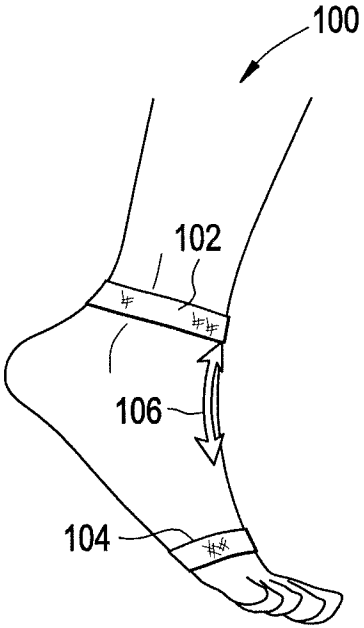

First, some general background information is provided for contextual purposes. FIGS. 1A through 1C illustrate a human foot and leg 100 in various stages of motion or use, namely, at a neutral position or orientation (FIG. 1A, e.g., standing), at a dorsiflexion position or orientation (FIG. 1B), and at a plantar flexion position or orientation (FIG. 1C). One band 102 at the ankle and one band 104 at the forefoot are maintained at constant positions on the illustrated foot throughout FIGS. 1A through 1C.

The double headed arrow 106 helps illustrate changes in foot volume and/or dimensions at various positions and/or during the course of a step cycle. As shown in FIG. 1A, when the foot is at the neutral position (e.g., standing upright), the arrow 106 extends from the lower side or edge of band 102 to the top side or edge of band 104. The same sized arrow 106 is reproduced in FIG. 1B when the foot is in a dorsiflexion position or orientation. Notably, in this position or orientation, the lower end of arrow 106 extends beyond the top side or edge of band 104 all the way to the bottom of the band 104, indicating that the foot length or volume over the instep area has changed from the neutral position (e.g., due to rotation of the ankle). Also, this same sized arrow 106 is reproduced in FIG. 1C when the foot is in a plantar flexion orientation or position. Notably, this position stretches out the top of the foot with respect to the ankle or shin (e.g., due to rotation of the ankle), as evidenced by the fact that the arrow 106 falls far short of the lower band 104.

At least some structures and aspects of this invention take advantage of these changes in foot volume/length over the course of a step cycle and/or in different phases of use or in other activities. More specifically, aspects of the present invention relate to motion activated performance systems that support a wearer's foot and adapt fit/support instantaneously to changing foot volume and/or dimension through full foot stance and/or step cycle positions and/or orientations (or other movements). Strap systems in accordance with at least some examples of this invention utilize the changes in volume/length of the foot and ankle during motion to facilitate shoe conformance to the variable shape of the foot. As a wearer's ankle goes through plantar flexion and dorsiflexion during a normal gait, while running, and/or even cutting and/or during other activities (e.g., jumping, starting from sprinter's blocks, etc.), strap systems according to at least some examples of this invention will remain tightened (and may even increase in tightness), leading to dynamic conformance of the shoe to the foot even as the foot changes shape. The various strap systems may be adjustable in length so that they can dynamically fit unique foot morphologies within the same foot size. Various example strap systems and configurations for achieving the motion activated footwear conformance/fit features of the present invention are described below.

FIGS. 2A through 2D illustrate lateral, top, medial, and bottom views, respectively, of a strap system 200 engaged with a bootie member 202 in accordance with one example of this invention. As shown in these figures and as will be explained in more detail below, strap system 200 wraps around the wearer's ankle, midfoot, and forefoot in one continuous loop. This example strap system 200 includes two separate strap members 200*a* and 200*b* that are engaged with one another at two separate locations. While the strap members 200*a* and 200*b* may be engaged with one another and/or with themselves at a variety of different locations, in this illustrated example, one engagement location 204*a* is provided at the medial forefoot area of the bootie member 202 (e.g., near the first metatarsal head area) and the other engagement location 204*b* is provided at the medial midfoot area of the bootie member 202.

The strap member(s) 200*a* and 200*b* may be made from any desired materials or with any desired constructions or specifications without departing from this invention. In the illustrated example, the strap members 200*a* and 200*b* are made from a strong, flexible fabric material, formed into an elongated strip of material (e.g., having a much greater length and width dimension than its thickness dimension). The strap members 200*a* and 200*b* may be at least 0.5 inches wide, or even at least 0.75 inches or at least 1 inch wide to better modulate the feel on the wearer's foot when tightened. The material may be stretchable (e.g., elastic), somewhat stretchable, or unstretchable (inelastic). The term "unstretchable" or "substantially unstretchable," as used herein and unless otherwise defined, refers to materials that stretch or increase in length less than 2% of its overall dimension in the length or width direction under any applied tensile force in that direction. In some examples, the "unstretchable materials" described herein will stretch or increase in length less than 1% of its overall dimension in the length or width direction under any applied tensile force in that direction. If desired, the strap member(s) 200*a* and 200*b* may include one or more wires, cables, fibers or other stretch resistant components engaged with them or incorporated into them to, at least in part, impart the unstretchability features.

The junctions between the strap members 200*a* and 200*b* in this example provide tensioning elements to enable the wearer to apply a force to tighten the straps (by shortening the length of the overall continuous path or loop traversed by the straps 200*a* and 200*b*). While any desired type of tensioning or force applying structures may be used without departing from this invention, in the illustrated example, one free end of each strap 200*a* and 200*b* includes a tensioning ring 206*a* and 206*b*. The other end of each strap 200*a* and 200*b* includes a securing mechanism, which in this illustrated example constitutes a portion of a hook-and-loop fastener element 208. The mating portion of the hook-and-loop fastener element 208 may be provided at another desired location on the overall shoe construction, such as on an exposed surface of straps 200*a* and 200*b*, on a surface of the bootie member 202, on another portion of the upper, on another portion of the overall shoe (or other foot-receiving device) structure, etc.

Other tensioning or force applying structures and/or securing mechanisms may be used without departing from this invention, including, for example, a buckle type structure, a clamp type structure, a rotary "take up" mechanism used to roll up excess strap, a ratchet mechanism, a cable tie type securing mechanism, buttons, snaps, etc.

Figure 2A:
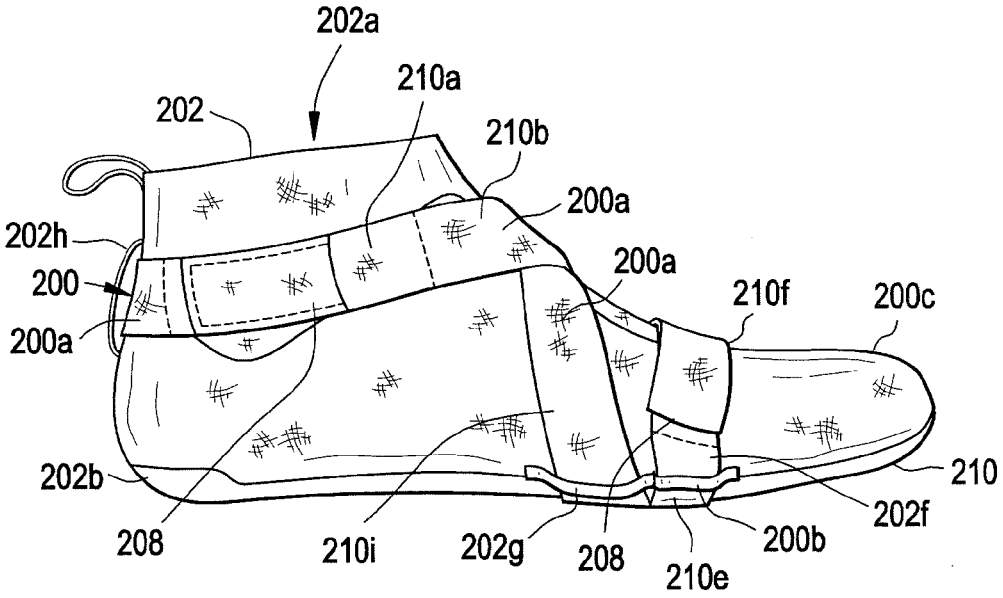
FIGS. 2A through 2D include various views of a strap system according to one example of this invention.
Figure 2B:
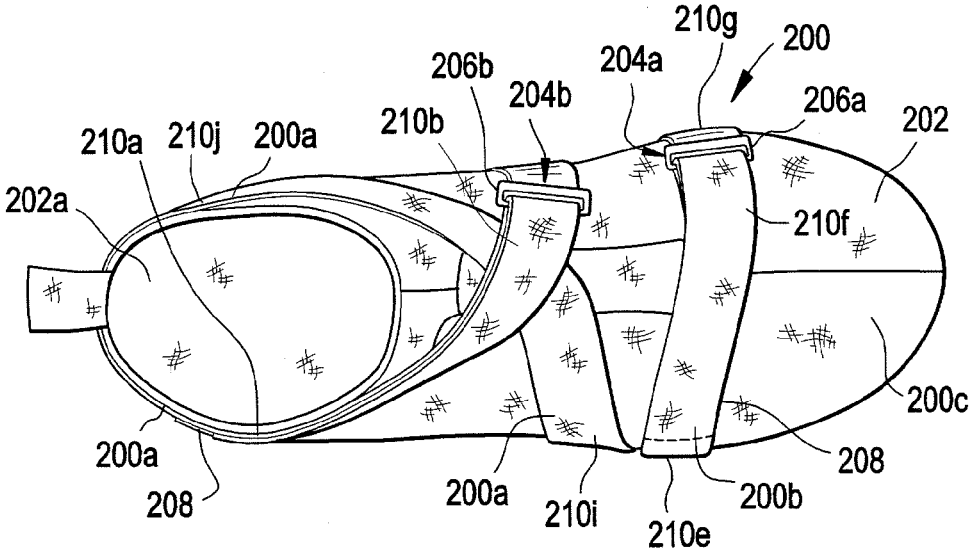
Figure 2C:
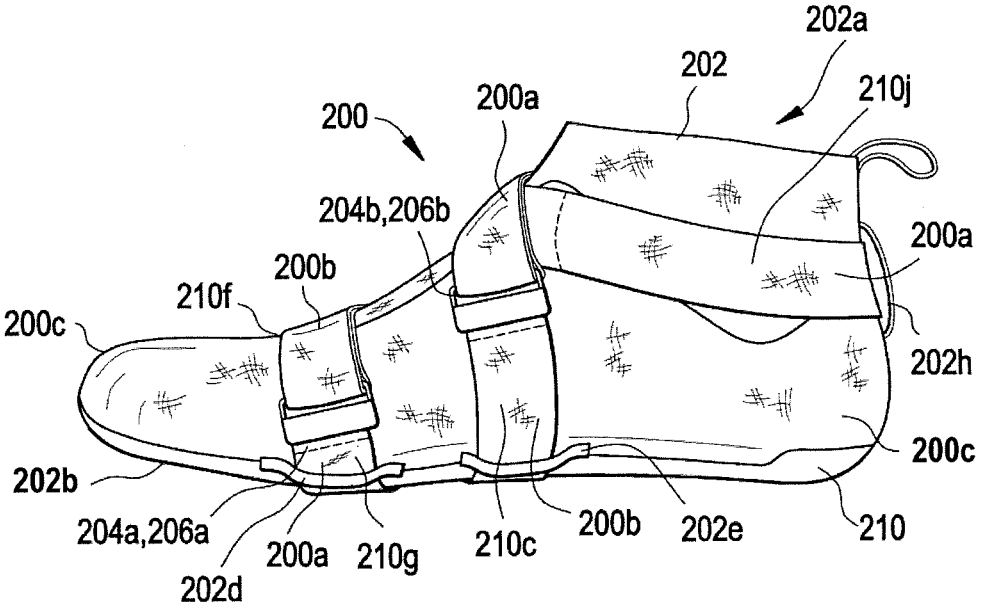
Figure 2D:
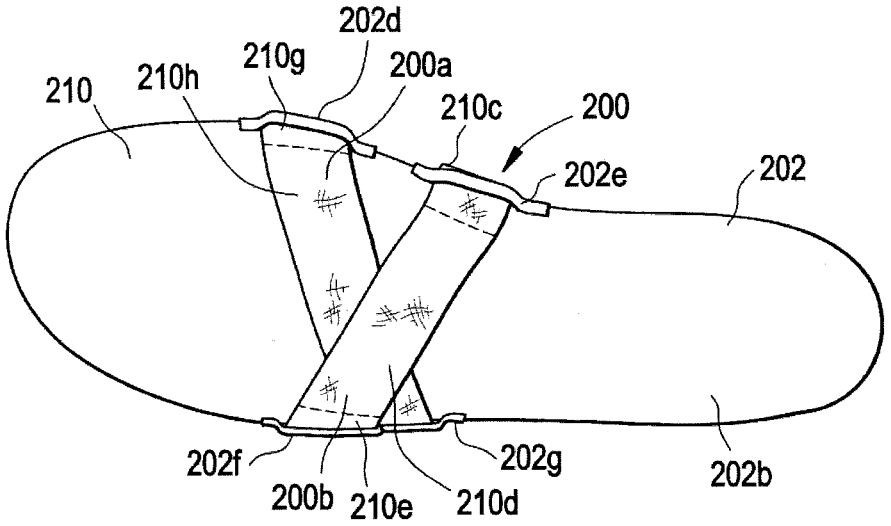

The overall "continuous path" of this example strap system 200 now will be described in more detail. As shown in FIGS. 2A through 2D, the first strap member 200*a* is engaged with the bootie element 202 and has its first free end (provided with tensioning ring 206*a*) located at a first metatarsal head area at the medial side of the bootie element 202. From there, the first strap member 200*a* wraps around the medial side edge of the bootie element 202 (see FIG. 2C), extends beneath a plantar surface area 210 of the bootie element 202 (FIG. 2D), then around the lateral side edge of the bootie element (FIG. 2A), over a lateral midfoot area of the bootie element 202 (FIGS. 2A and 2B), across a front instep area of the bootie element 202 (FIG. 2B), around a medial ankle opening area of the bootie element 202 (FIGS. 2B and 2C), around a rear ankle opening area of the bootie element 202, along a lateral ankle opening area of the bootie element 202 (FIGS. 2A and 2B), and again across the front instep area of the bootie element 202 (FIG. 2B) to the medial side of the bootie element 202. The second strap member 200*b* is engaged with the bootie element 202 and has its first free (including tensioning ring 206*b*) located at a medial midfoot area (the arch area) of the bootie element 202 (FIG. 2C). From there, the second strap member 200*b* wraps around the medial side edge of the bootie element 202, extends beneath the plantar surface area 210 of the bootie element (FIGS. 2C and 2D), around the lateral side edge of the bootie element 202 at or proximate to the fifth metatarsal head area (FIGS. 2A and 2D), across a top forefoot area of the bootie element 202 (FIG. 2B), and toward the first metatarsal head area of the bootie element 202. The free end of the first strap member 200*a* engages the second strap member 200*b* at the medial forefoot area (e.g., adjacent the first metatarsal head, at location 204*a*), and the free end of the second strap member 200*b* engages the first strap member 200*a* at the medial midfoot area (at location 204*b*).

As noted above, the specific strap system 200 example of FIGS. 2A through 2D includes two separate strap members 200*a* and 200*b* that are joined together at two locations on the medial side of the bootie element 202. These specific features are not requirements. Any number of strap members may be used to create this type of strap system 200, e.g., provided the strap system forms a continuous path along the upper or bootie member 202. The path according to this example construction (divided up as shown by broken lines in FIGS. 2A through 2D) includes: (a) a first strap portion 210*a* extending along a lateral ankle opening area, (b) a second strap portion 210*b* extending from the first strap portion 210*a* and across a front of the ankle opening area, (c) a third strap portion 210*c* extending from the second strap portion 210*b* and along a medial midfoot area (e.g. around the medial edge of the bootie element 202), (d) a fourth strap portion 210*d* extending from the third strap portion 210*c* and beneath a plantar surface area 210, (e) a fifth strap portion 210*e* extending from the fourth strap portion 210*d* and around a lateral side area (e.g., around a lateral edge of the bootie element 202) at or near a fifth metatarsal head area, (f) a sixth strap portion 210*f* extending from the fifth strap portion 210*e* and across a top forefoot area, (g) a seventh strap portion 210*g* extending from the sixth strap portion 210*f* and around a medial side area (e.g., around the medial edge of the bootie element 202) at or near a first metatarsal head area, (h) an eighth strap portion 210*h* extending from the seventh strap portion 210*g* and beneath the plantar surface area 210, (i) a ninth strap portion 210*i* extending from the eighth strap portion 210*h*, around the lateral side edge of the bootie element 202 and across the front of the ankle opening area, and (j) a tenth strap portion 210*j* extending from the ninth strap portion 210*i* and along a medial ankle opening area. Optionally, if desired, the tenth strap portion 210*j* may be engaged with the first strap portion 210*a* (e.g., around the rear heel area of the ankle opening) to thereby produce a continuous loop around the bootie element 202.

A means for applying a force to the one or more strap members so as to shorten a length of the continuous path may be provided at any desired location(s) along the path. As noted above, such means may include tensioning elements and hook-and-loop type fasteners, buckle type structures, clamp type structures, rotary "take up" mechanisms used to roll in excess strap, ratchet mechanisms, cable tie type securing mechanisms, buttons, snaps, etc. In the illustrated embodiment, the means for applying force includes a tensioning system provided between the second strap portion 210*b* and the third strap portion 210*c* and another tensioning system provided between the sixth strap portion 210*f* and the seventh strap portion 210*g*. Other options also are possible. For example, junctions between separate strap members could be provided along the lateral side of the bootie element 202 (and include tensioning elements and/or other means for applying force). As another example, if desired, separate strap members or opposite ends of a single strap member may be joined at the rear heel area (e.g., a rotary take up reel or ratchet mechanism between strap portions 210*a* and 210*j*), and an appropriate means for applying force may be provided. As yet additional examples, separate strap members or opposite ends of a single strap member may be joined at the location in the instep area where the strap portions cross and/or in the top forefoot area (e.g., joined by an appropriate means for applying force). Other options for joining a single strap or independent strap members and/or tensioning devices for applying a force may be used without departing from this invention.

The location of and the dividing lines between the various strap portions discussed above and shown by the broken lines in FIGS. 2A thru 2D are selected somewhat arbitrarily, e.g., based on the discernible locations with respect to a wearer's foot. These features are provided in the drawings as a visual aide to help describe and explain these features of the invention.

FIGS. 2A through 2D also illustrate features of a bootie member 202 that may be used to support strap system 200 and/or as at least a portion of an upper for an article of footwear or other foot-receiving device in accordance with aspects of this invention. As illustrated in these figures, this example bootie member 202 includes a base bootie component 202*c*, e.g., made from one or more pieces of a soft, comfortable feeling fabric, optionally including stretchable fabric(s) at various locations to facilitate insertion of a wearer's foot through the ankle opening 202*a* (e.g., such as LYCRA SPANDEX or other stretchable material at or near the foot-receiving opening). The illustrated bootie member 202 further includes a separate footbed component 202*b* engaged with the base bootie component 202*c*, e.g., by sewing, stitching, adhesives, cements, etc. The footbed component 202*b* supports the plantar surface of a wearer's foot and may include appropriate curvature or structure to comfortably engage and support a wearer's foot. The footbed component 202*b* may be somewhat more rigid, strong, and/or wear resistant as compared to the base bootie component 202*c*.

The bootie member 202 may include structure for securing the strap system 200 to the bootie member 202. In this illustrated example, the bootie member 202 includes: (a) a first loop element 202*d* engaged with or formed in a medial side edge area of the bootie component 202, e.g., at or near the first metatarsal head area, (b) a second loop element 202*e* engaged with or formed in the medial side edge area of the bootie component 202 and located longitudinally rearward from the first loop element 202*d* (e.g., in an arch area), (c) a third loop element 202*f* engaged with or formed in a lateral side edge area of the bootie component 202 (e.g., at or near the fifth metatarsal head area), and (d) a fourth loop element 202*g* engaged with or formed in the lateral side edge area of the bootie component 202 and located longitudinally rearward from (and optionally immediately adjacent to) the third loop element 202*f*. The medial side loop elements 200*d* and 200*e* may be spaced further apart from one another as compared to the lateral side loop elements 200*f* and 200*g*. The lateral side loop elements 200*f* and 200*g* may share at least some common structural parts if desired (e.g., they may be located immediately adjacent one another, optionally sharing a single loop strip that may be split into two halves in the central area by a seam). This example bootie member 202 further includes an additional loop element 202*h* engaged with or formed in a rear heel portion of the bootie component 202*c*, e.g., adjacent the ankle opening 202*a*. The various loop elements 202*d* through 202*h* may be engaged with the fabric material of the base bootie component 202*c* and/or the footbed 202*b* (e.g., at a junction of these components), or they may be integrally formed in or as part of one of these components (e.g., as part of a knitting or weaving step used to produce the components, cut into the components as a slit or covered channel, etc.).

The loop elements 202*d* through 202*h* of this illustrated example function in a manner akin to a conventional belt loop (i.e., the strap member 200 is fed through the open space defined between the loop element and the bootie member part(s) to which it is attached). Furthermore, in this illustrated example, each of the first, second, third, and fourth loop elements 202*d* through 202*g* are oriented to extend substantially along a longitudinal direction of the bootie member 202 (e.g., generally in a toe-to-heel center line direction) so as to define strap receiving openings oriented in a direction offset from the longitudinal direction. In the illustrated example, the strap receiving openings defined by loop elements 202*d* through 202*g* are oriented so as to hold the strap member 200 in place as the strap portions extend over an edge of the bootie member 200 (e.g., from the plantar surface to the top or side surfaces or from the top or side surfaces to the plantar surface). Loop elements may be provided at other or different locations as well.

FIGS. 2A through 2D further show that the strap system 200 may be engaged with the bootie member 202 (or foot-receiving device upper) in a free floating manner, i.e., no portion of the strap member 200 is permanently fixed to any portion of the bootie member 202 (or foot-receiving device component). The strap members 200*a* and 200*b* of strap system 200 cross on top of the midfoot (in front of the ankle opening 202*a*) and beneath the plantar support surface 210. In use, the strap system 200 tightens as the foot plantar flexes as shown in FIG. 1C. This action increases the length of the strap portions on the forefoot area of the bootie element 202 or shoe (to cover the greater distance shown in FIG. 1C), which in turn pulls upward on the strap portions located beneath the plantar surface 210 of the bootie element 202 or shoe and draws the bootie element 202 or shoe into the wearer's arch and causes it to conform to the foot shape. When the strap system 200 is free to move all of the way around the foot and ankle as shown in this example construction, the tendency for shoes to "tent" is reduced (as compared with traditional shoes), and the change of foot volume/length is fully utilized for shoe conformance, leading to a higher level of performance. The guides (e.g., loop elements 202*d* through 202*g*) help ensure that the strap system 200 stays positioned at and/or near the first and fifth metatarsal heads.

The construction of FIGS. 2A through 2D may be incorporated into an article of footwear structure, e.g., by engaging the bootie member 202 with another portion of a footwear upper and/or with a sole structure (e.g., optionally including a midsole element (e.g., foam, fluid-filled bladder, etc.), and outsole element, or the like). In such constructions, the engagement between the footbed 202*b* and the other sole components may include a gap, channel, or other sufficient clearance to allow the strap system 200 to move with respect to the other components of the shoe (i.e., to maintain the "free floating" capabilities as described above). Also, if desired, some or all portions of the bootie member 202 exterior may be covered by another material, such as plastics, rubbers, TPUs, synthetic or natural leather, or the like, e.g., to increase the durability, abrasion resistance, and wear resistance of the overall footwear construction. If at least partially covered, the cover material may be positioned and/or engaged with the shoe so as to allow the strap system 200 to move with respect to the other components of the upper (i.e., to maintain the "free floating" capabilities as described above). If necessary or desired, the strap system 200 may be coated or otherwise reinforced at appropriate positions to prevent excessive wear or fraying of the individual strap member(s). As another possibility, guide surfaces or other structures may be provided in the bootie or sole structure with appropriate surfaces (e.g., rounded surfaces) to reduce the coefficient of friction with respect to the strap system 200 and/or to otherwise prevent wear and/or facilitate the relative motion described above.

Figure 3B:
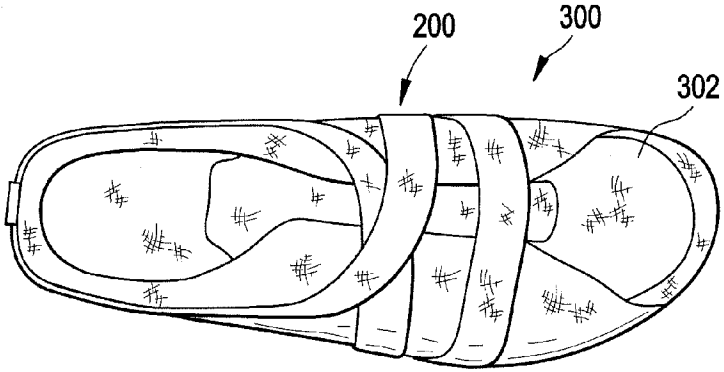
FIGS. 3A through 3C illustrate various views of an article of footwear including a strap system of the type shown in FIGS. 2A through 2D.
Figure 3A:
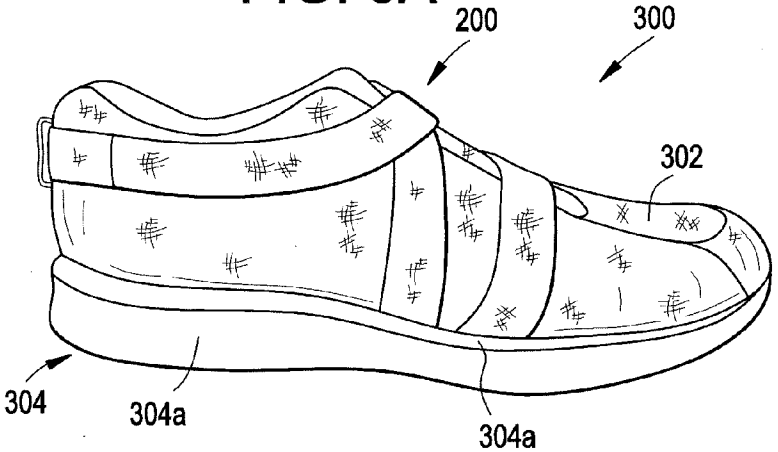
Figure 3C:
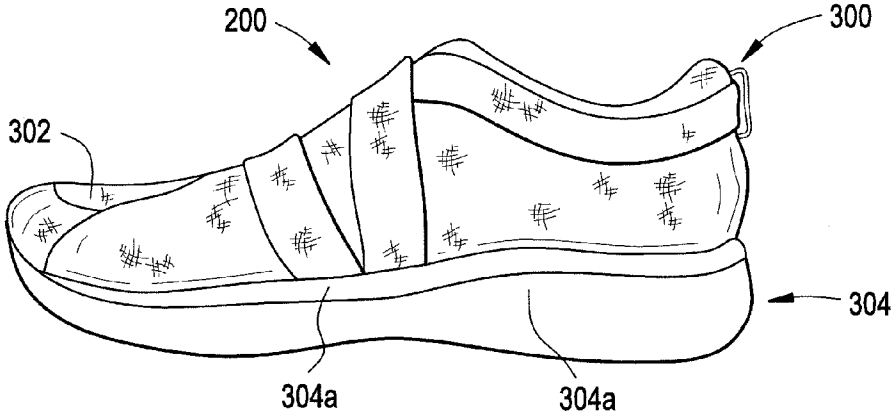

FIGS. 3A through 3C illustrate an example article of footwear 300 in which a strap system 200 like that described above (having the same general continuous loop) incorporated into it. While it may be used in any desired type of shoe (and particularly any desired type of athletic shoe), in this illustrated example, the shoe 300 is a running or walking shoe. In this example footwear 300 construction, the bootie element 202 is omitted and the strap system 200 is engaged with the article of footwear 300 (e.g., with upper member 302 and/or some portion of the sole structure 304). In addition to the strap system 200, this example article of footwear 300 may include a conventional lace system in the footwear instep area to help engage the article of footwear with the wearer's foot (not shown in these figures).

In this illustrated example, the portions of the strap system 200 that extend beneath the plantar support surface area of the shoe 300 extend through a channel defined between the upper 302 and a midsole element 304*a* of the shoe sole 304. If desired, one or more portions of the strap system 200 may extend beneath at least a portion of a midsole layer without departing from this invention (e.g., between midsole layers, between a midsole layer and an outsole layer, etc.). Appropriate strap element guides (e.g., like the loop members described above) may be provided at appropriate locations to help maintain the strap portions at their desired positions.

If desired, the strap member(s) may engage around the upper 302 on rollers or other surfaces or structures (e.g., smooth, rounded edges) so as to produce non-abrasive contact and/or a low coefficient of friction for movement of the strap member(s) with respect to other shoe structures in a free floating manner, as described above. As another potential option, if desired, portions of the strap system 200 may extend below the outsole member, e.g., in the arch area.

Figure 4A:
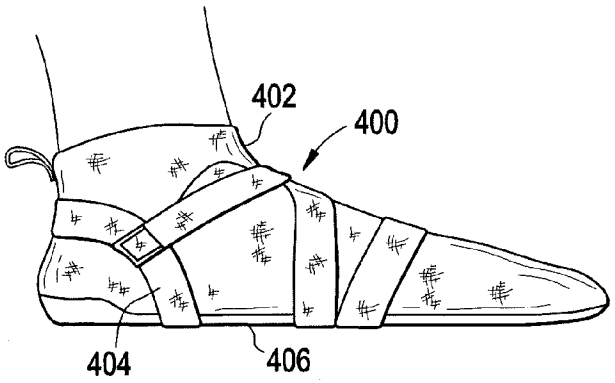
FIGS. 4A through 4D include various views of a strap system according to another example of this invention.
Figure 4B:
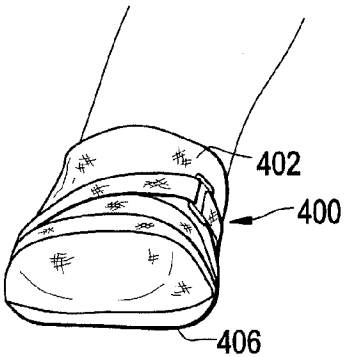
Figure 4C:
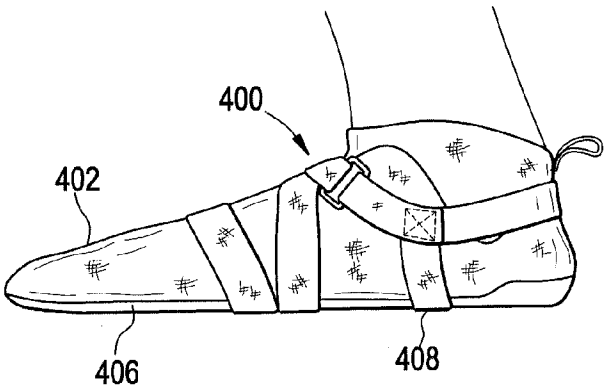
Figure 4D:
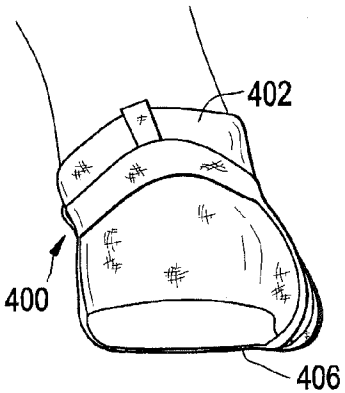

FIGS. 4A through 4D show various views of another example strap system 400 in accordance with at least some examples of this invention. This example strap system 400 has strap portions included in one or more strap members that follow the same general continuous path or loop described above in conjunction with FIGS. 2A through 2D. More specifically, as shown in FIG. 4A through 4D, this example strap system 400 includes one or more strap members that form a continuous path along an upper or bootie member as follows: (a) a first strap portion that extends along a lateral ankle opening area (FIG. 4A), (b) a second strap portion that extends from the first strap portion and across a front of the ankle opening area (FIGS. 4A through 4C), (c) a third strap portion that extends from the second strap portion and along a medial midfoot area (e.g. around the medial edge of the bootie element 402, FIG. 4C), (d) a fourth strap portion that extends from the third strap portion and beneath a plantar surface area, (e) a fifth strap portion that extends from the fourth strap portion and around a lateral side area (e.g., around a lateral edge of the bootie element 402) at or near a fifth metatarsal head area (FIG. 4A), (f) a sixth strap portion that extends from the fifth strap portion and across a top forefoot area (FIGS. 4A and 4B), (g) a seventh strap portion that extends from the sixth strap portion and around a medial side area (e.g., around the medial edge of the bootie element 402, FIG. 4C) at or near a first metatarsal head area, (h) an eighth strap portion that extends from the seventh strap portion and beneath the plantar surface area, (i) a ninth strap portion that extends from the eighth strap portion, around the lateral side edge of the bootie element 402 and across the front of the ankle opening area (FIG. 4A), and (j) a tenth strap portion that extends from the ninth strap portion and along a medial ankle opening area (FIG. 4C). Optionally, if desired, the tenth strap portion may be engaged or integrally formed with the first strap portion (e.g., around the rear heel area of the ankle opening) to thereby produce a continuous loop around the bootie element 402.

The bootie element 402 further may include loop elements of the types described above, or other appropriate structures to help keep the strap member 400 properly located with respect to the bootie element 402. The loop elements or other strap retaining mechanisms may be of the same constructions and/or at the same positions as described above in conjunction with FIGS. 2A through 2D, although variations in structures and positions are possible.

While similar to strap system 200 as described above, this example strap system 400 includes two additional strap portions or components. More specifically, as shown in FIG. 4A, the strap portion extending along the lateral ankle opening has a strap portion 404 that extends downward toward the plantar surface area 406 of the bootie element 402. Also, as shown in FIG. 4C, the strap portion extending along the medial ankle opening has a strap portion 408 that extends downward toward the plantar surface area 406 of the bootie element 402. In fact, strap portions 404 and 408 of this example structure 400 extend beneath the plantar surface area and are engaged with the plantar surface of the bootie member 402 (e.g., fixed by sewing, adhesives, etc.). Preferably, the strap portions 404 and 408 will extend beneath the plantar surface area by at least 10 mm. Alternatively, if desired, the two strap portions 404 and 408 may be connected to one another under the plantar surface or formed as a unitary, one-piece construction (i.e., opposite ends of a single strap).

The additional strap portions 404 and 408 form a portion of a "heel lock" type structure so that the overall strap system 400 provides lateral containment as well as kinematic conformance. While this example strap system 400 has fixed attachment (beneath the plantar surface) of strap portions 404 and 408, the remainder of the strap system 400 remains free to move around the foot in other areas in order to provide the foot conformance features discussed above. This strap system 400, when used during a cutting motion (e.g., in a basketball, football, soccer, or other type of athletic shoe), provides both rearfoot and forefoot stability during the beginning of the cut and conformance to the arch and forefoot during the push-off phase of the cut.

If desired, rather than being sewn to other portions of the strap system 400, the tops of the strap portions 404 and 408 may form a loop or include another structure through which the lateral and medial ankle portions of strap member 400 extend.

FIGS. 5A through 5D provide various views of an example article of footwear 500 constructed as a basketball shoe including a strap system 400 like that described above in conjunction with FIGS. 4A through 4D (e.g., having the same general continuous loop). In this example footwear 500 construction, the bootie element 402 is incorporated into the overall upper structure with the strap system 400 engaged with it. The portions of the strap system 400 that extend beneath the plantar surface area of the bootie 402 may extend through a channel defined between the bootie 402 and a midsole element 504*a* of the shoe sole 504. If desired, one or more portions of the strap system 400 may extend beneath at least a portion of a midsole layer without departing from this invention (e.g., between midsole layers, between a midsole layer and an outsole layer, etc.). Appropriate strap element guides (e.g., like the loop members described above) may be provided at appropriate locations on the bootie member 402 (as noted above), on the upper 502, and/or on the sole member 504 to help maintain the strap portions at their desired positions. As another alternative, if desired, one or more portions of the strap system 400 may extend beneath the outsole, e.g., at the arch area.

Figure 5B:
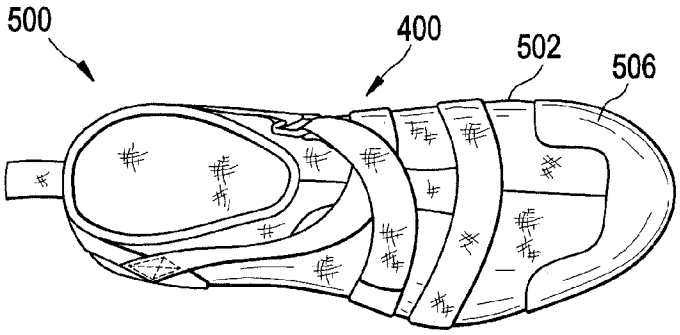
FIGS. 5A through 5D illustrate various views of an article of footwear including a strap system of the type shown in FIGS. 4A through 4D.
Figure 5D:
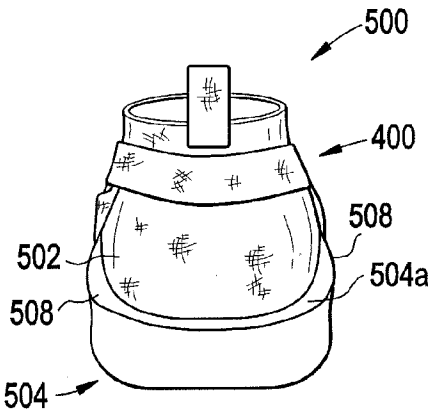
Figure 5A:
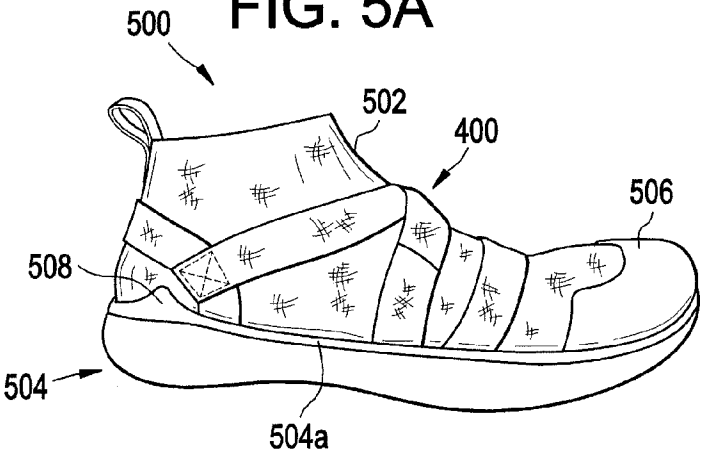
Figure 5C:
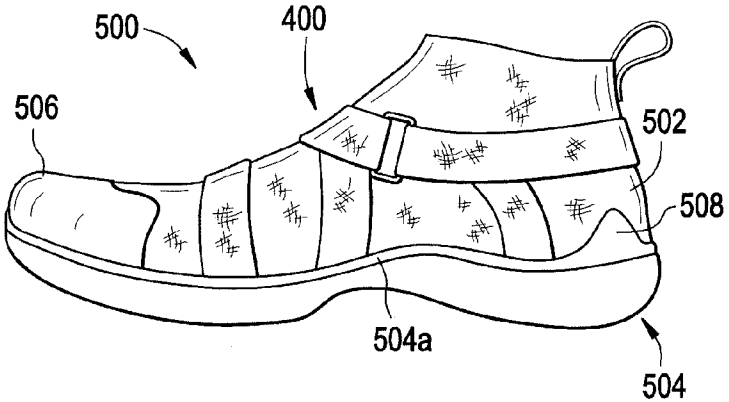

Also, if desired, some or all portions of the bootie member 402 exterior may be covered by another material, such as a thermoplastic polyurethane, a synthetic leather, natural leather, a plastic component, a rubber component, or the like, e.g., to increase the durability, abrasion resistance, and wear resistance of the overall footwear construction (or at least portions thereof). This is shown in FIGS. 5A through 5C, for example, as the rubber toe cap member 506 and the lower heel covering members 508. If at least partially covered, the cover material may be positioned and/or engaged with the shoe so as to allow the strap system 400 to move with respect to the other components of the upper (i.e., to maintain the "free floating" capabilities as described above). If necessary or desired, the strap system 400 may be coated or otherwise reinforced, at least at some locations, to prevent excessive wear or fraying of the individual strap member(s).

Footwear conformance to the arch area during plantar flexion can be accomplished in other ways without departing from this invention. For example, rather than using a completely free-floating strap system, like systems 200 and 400 described above, some example strap systems in accordance with this invention may have some portion(s) fixed to the upper (optionally to a bootie member that forms at least a portion of an upper). FIGS. 6A through 6D show one example of such a strap system 600 engaged with an upper (in this instance, with a bootie member 602).

FIGS. 6A through 6D illustrate lateral, top, medial, and bottom views, respectively, of strap system 600 engaged with an exterior surface of a bootie member 602 in accordance with one example of this invention. As shown in these figures and as will be explained in more detail below, strap system 600 wraps around the wearer's ankle, midfoot, and forefoot in a continuous path. This example strap system 600 includes two separate strap members 600*a* and 600*b* that are engaged with one another at one location. While the strap members 600*a* and 600*b* may be engaged with one another at a variety of different locations, in this illustrated example, the engagement location 604*a* is provided at the lateral ankle opening area of the bootie member 602.

The strap member(s) 600*a* and 600*b* may be made from any desired materials or with any desired constructions or specifications without departing from this invention. In the illustrated example, the strap members 600*a* and 600*b* are made from a strong, flexible fabric material, formed into an elongated strip of material (e.g., having a much greater length and width dimension than its thickness dimension), optionally about 0.5 inches to 1.5 inches wide (and in some examples, about 0.75 or 1 inch wide). The material may be stretchable (e.g., elastic), somewhat stretchable, or unstretchable (inelastic). If desired, the strap member(s) 600*a* and 600*b* may include one or more wires, cables, fibers, or other stretch resistance components engaged or included with them to, at least in part, impart the unstretchability features.

Figure 6B:
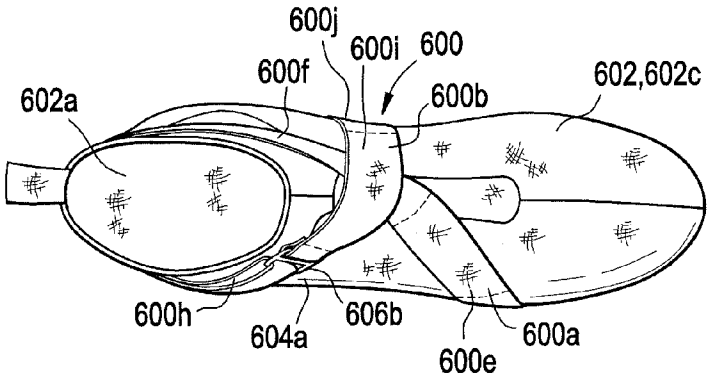
FIGS. 6A through 6D include various views of a strap system according to another example of this invention.
Figure 6D:
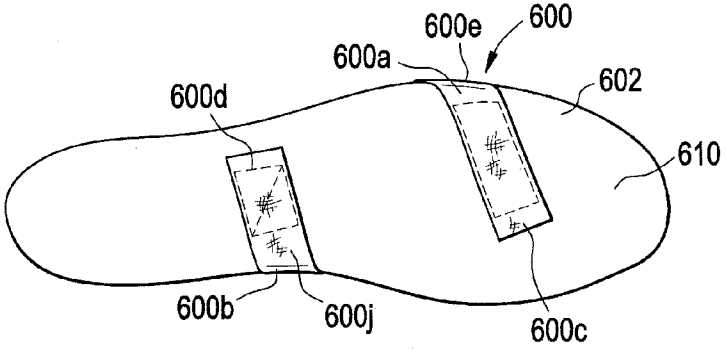
Figure 6A:
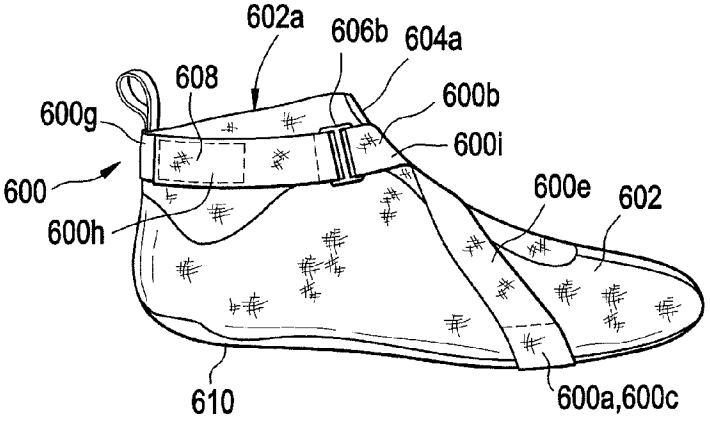
Figure 6C:
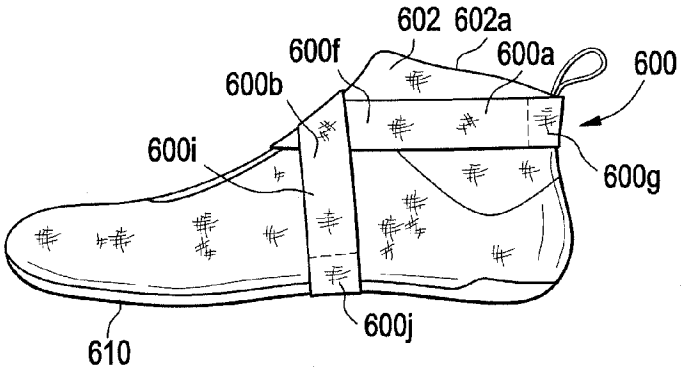

One end of each of strap members 600*a* and 600*b* is fixed to an underside of the bootie element 602, e.g., by stitching or sewing, or other desired fixed connection mechanisms. As shown in FIG. 6D, the strap members 600*a* and 600*b* extend and are fixed more than halfway across the bottom of the bottom surface 610 of the bootie element 600, and the strap members 600*a* and 600*b* extend and are engaged along a direction generally parallel to the direction in which the strap members 600*a* and 600*b* extend as they begin to move away from the bottom side of the bootie element 602 toward its side and/or top surfaces.

The junction between the strap members 600*a* and 600*b* in this example provides a tensioning system to enable the wearer to apply a force to tighten the straps (by shortening the length of the overall continuous path traversed by the strap members 600*a* and 600*b*). While any desired type of tensioning or force applying structures may be used without departing from this invention, in the illustrated example, the free end of strap member 600*b* includes a tensioning ring 606*b*, and the free end of strap member 600*a* includes a securing mechanism, which in this illustrated example constitutes a portion of a hook-and-loop fastener element 608. The mating portion of the hook-and-loop fastener element 608 may be provided at another desired location on the overall bootie or shoe construction, such as on an exposed surface of strap 600*a*, on a surface of the bootie member 602, on another portion of an upper including the strap system 600, on another portion of the overall shoe (or other foot-receiving device) structure including the strap system 600, etc.

Other tensioning or force applying structures and/or securing mechanisms may be used without departing from this invention, including, for example, a buckle type structure, a clamp type structure, a rotary "take up" mechanism used to roll in excess strap, a ratchet mechanism, a cable tie type securing mechanism, buttons, snaps, etc.

The overall "continuous path" of this example strap system 600 will be described in more detail. As shown in FIGS. 6A through 6D, the first strap member 600*a* includes a first end 600*c* fixed with or beneath the footbed 610 at a forefoot portion of the bootie element 602. This first strap member 600*a* extends around a lateral forefoot or midfoot edge of the bootie element 602, across an instep area of the bootie element 602, around a medial ankle opening area of the bootie element 602, and around a rear ankle opening area of the bootie element 602. The second strap member 600*b* has a first end 600*d* fixed with or beneath the footbed 610 at a midfoot portion of the bootie element 602 (e.g., in the arch area), and this second strap member 600*b* extends around a medial midfoot edge of the bootie element 602, across the instep area of the bootie element 602, and to a lateral ankle opening area of the bootie element 602. As noted above, the first strap member 600*a* engages the second strap member 600*b* at the lateral ankle opening area of the bootie element 602. As best shown in FIG. 6B, the first strap member 600*a* crosses the second strap member 600*b* in front of the ankle opening area 602*a*.

While not shown in FIGS. 6A through 6D (and perhaps less necessary due to the fixed ends 600*c* and 600*d* of the strap members 600*a* and 600*b*, respectively), if desired, the bootie element 602 or other portions of the shoe structure associated with the strap system 600 may include one or more loop elements or other strap securing element to engage and guide the strap members 600*a* and 600*b* (e.g., like loop elements 202*d* through 202*h* described above). Also, while not shown in FIGS. 6A through 6D, the strap member(s) 600*a* and 600*b* may include additional strap portions extending toward the footbed 610 and forming a portion of a "heel lock" as illustrated and described above in conjunction with strap portions 404 and 408 in FIGS. 4A through 4D.

As noted above, the specific strap system 600 example of FIGS. 6A through 6D includes two separate strap members 600*a* and 600*b* that are joined together at one location on the lateral side of the bootie element 602. These features are not requirements. Any number of strap members may be used to create this type of strap system 600, provided the strap system forms a continuous path along an upper or bootie member 602. The path according to this example construction (as represented by broken lines in FIGS. 6A through 6D) includes: (a) a first strap portion 600*c* fixed with or beneath a footbed 610 of the bootie element 602 at a forefoot area, wherein the first strap portion extends around a lateral forefoot or midfoot edge (see FIG. 6D), (b) a second strap portion 600*e* extending from the first strap portion 600*c* and across an instep area (FIGS. 6A and 6B), (c) a third strap portion 600*f* extending from the second strap portion 600*e* and around a medial ankle area (FIGS. 6B and 6C), (d) a fourth strap portion 600*g* extending from the third strap portion 600*f* and around a rear ankle area (FIGS. 6A and 6C), (e) a fifth strap portion 600*h* extending from the fourth strap portion 600*g* and along a lateral ankle area (FIGS. 6A and 6B), (f) a sixth strap portion 600*i* extending from the fifth strap portion 600*h* and across the instep area (FIGS. 6A, 6B, and 6C), and (g) a seventh strap portion 600*j* extending from the sixth strap portion 600*i* and around a medial midfoot edge (FIGS. 6C and 6D), wherein the end 600*d* of the seventh strap portion 600*j* is fixed with or beneath the footbed 610 at a midfoot area.

A means for applying a force to the one or more strap members so as to shorten a length of the continuous path may be provided at any desired location(s) along the path. As noted above, such means may include tensioning elements and hook-and-loop type fasteners, buckle type structures, clamp type structures, rotary "take up" mechanisms used to roll in excess strap, ratchet mechanisms, cable tie type securing mechanisms, buttons, snaps, etc. In the illustrated embodiment, the means for applying force are provided between the fifth strap portion 600*h* and the sixth strap portion 600*i*. Other options also are possible. For example, the junction between the separate strap members could be provided along the medial side of the bootie element 602 (and include tensioning elements and/or other means for applying force at that location). As another example, if desired, separate strap members may be joined at the rear heel area (e.g., within strap portion 600*g*), and an appropriate means for applying force may be provided (e.g., a rotary "take up" mechanism, a ratchet mechanism, etc.). As yet additional examples, separate strap members may be joined at the location in the instep area where the strap portions cross and/or in the top forefoot area (e.g., joined by an appropriate means for applying force). Other options for joining independent strap members and or positioning devices for applying a force may be used without departing from this invention.

The locations of and the dividing lines between the various strap portions discussed above and shown by the broken lines in FIGS. 6A thru 6D are selected somewhat arbitrarily, e.g., based on the discernible locations with respect to a wearer's foot. These features are provided in the drawings as a visual aide to help describe and explain these features of the invention.

FIGS. 6A through 6D also illustrate features of a bootie member 602 that may be used as at least a portion of an upper for an article of footwear or other foot-receiving device in accordance with this aspect of the invention. As illustrated in these figures, this example bootie member 602 includes a base bootie component 602*c*, e.g., made of one or more pieces of a soft, comfortable feeling fabric, optionally including stretchable fabric(s) at various locations to facilitate insertion of a wearer's foot through the ankle opening 602*a* (i.e., the foot-receiving opening). The illustrated bootie member 602 further includes a separate footbed component 610 engaged with the base bootie component 602*c*, e.g., by sewing, stitching, adhesives, cements, etc. The footbed component 610 supports the plantar surface of a wearer's foot and may include appropriate curvature or structure to comfortably engage and support a wearer's foot. The footbed component 610 may be somewhat more rigid and strong as compared to the base bootie component 602*c*.

FIGS. 6A through 6D further show that the strap system 600 is fixed to the bootie element (or other upper portion) at two ends 600*a* and 600*b*, but the remainder is engaged with the bootie member 602 in a movable, floating manner. The strap members 600*a* and 600*b* of strap system 600 cross on top of the midfoot (in front of the ankle opening 602*a*). In use, the strap system 600 tightens as the foot plantar flexes as shown in FIG. 1C. This action increases the length of the strap portions on the forefoot area of the shoe (to cover the greater distance shown in FIG. 1C), which in turn pulls upward on the strap portions 600*a* and 600*b* located and fixed beneath the bottom surface 610 of the bootie element 602. This action draws the shoe (bootie element 602) into the wearer's arch and causes it to conform to the forefoot shape. With the strap system 600 engaged as shown in this example construction, the tendency for shoes to "tent" is reduced (as compared with traditional shoes), and the change of foot volume/length is fully utilized for shoe conformance, leading to a higher level of performance. Similar to the free floating structures described above, the strap system 600 causes the shoe to conform to the arch during plantar flexion. More specifically, this strap system 600 (like strap system 200) pulls the fifth metatarsal upward during plantar flexion to help prevent the lateral midsole from being pulled under, e.g., during lateral movements. As shown, the attachment site in the arch can be moved more toward the center of the foot to allow for greater conformance of the footbed 610 (and any shoe containing the footbed 610) to the arch.

The strap system structure 600 of FIGS. 6A through 6D has one notable advantage as compared to the strap system 200 of FIGS. 2A through 2D in that the strap system 600 of FIGS. 6A through 6D eliminates the need to have the straps move freely underfoot. Additionally, the strap(s) can be attached to the footbed 610 at the bight line, allowing it (them) to be added to a strobel upper pattern.

The strap system 600 construction of FIGS. 6A through 6D may be incorporated into an article of footwear structure, e.g., by engaging the bootie member 602 with a sole structure (e.g., optionally including a midsole element (e.g., foam, fluid-filled bladder, etc.), and outsole element, or the like). In this example of the invention, the engagement between the footbed 610 and the sole components may include a gap, channel, or other sufficient clearance to allow the strap system 600 to move somewhat with respect to the other components of the shoe. Also, if desired, some or all portions of the bootie member 602 exterior may be covered by another material, such as synthetic or natural leather, plastics, TPUs, rubbers, or the like, e.g., to increase the durability, abrasion resistance, and wear resistance of the overall footwear construction. If at least partially covered, the cover material may be positioned and/or engaged with the bootie, upper, and/or other portions of the shoe so as to allow the strap system 600 to move with respect to the other components of the upper. If necessary or desired, the strap system 600 may be coated or otherwise reinforced at appropriate positions to prevent excessive wear or fraying of the individual strap member(s). Alternatively, if desired, the bootie element 602 may be omitted, and the strap system may be directly engaged around a shoe structure, e.g., around an upper in the general manner illustrated in FIGS. 3A through 3C.

All of the above example structures according to this invention describe strap systems that help the article of footwear conform to changing foot volume/length during plantar flexion. In other examples, strap systems can be arranged so that the strap(s) tighten when the foot moves from plantar flexion to dorsiflexion. Such strap systems could be exploited in footwear (or other foot-receiving devices) used for sports in which the plantar flexed position of the foot is optimal, such as for sprinting.

FIGS. 7A through 7E illustrate lateral, top, medial, bottom, and rear views, respectively, of strap system 700 having the function described immediately above engaged with an exterior surface of a bootie member 702 in accordance with an example of this invention. As shown in these figures and as will be explained in more detail below, strap system 700 wraps around the wearer's ankle, midfoot, and forefoot in a continuous path (and optionally in a continuous loop). This example strap system 700 includes a single strap member 700*a*, although multiple strap members could be used without departing from this invention. While the ends of the strap member 700*a* may be engaged with one another at a variety of different locations, in this illustrated example, the engagement location 704*a* is provided at the medial ankle area of the bootie member 702.

The strap member(s) 700*a* may be made from any desired materials or with any desired constructions or specifications without departing from this invention, including the various constructions and materials described above. Also as described above, the strap material may be stretchable (e.g., elastic), somewhat stretchable, or unstretchable (inelastic), and the strap member(s) 700*a* may include one or more wires, cables, fibers, or other stretch resistant components engaged with or incorporated into them to, at least in part, impart the unstretchability features.

The junction between the free ends of strap member 700*a* in this example provides a tensioning element to enable the wearer to apply a force to tighten the strap (by shortening the length of the overall continuous path traversed by the strap 700*a*). Any desired type of tensioning or force applying structures may be used without departing from this invention, including any of the various types described above (a hook-and-loop fastener system in shown in these figures).

As shown in FIGS. 7A through 7E, the strap system 700 of this example structure includes one or more strap members formed or engaged together in a continuous path along an upper for an article of footwear or other foot-receiving device (a bootie element 702 in this illustrated example). The strap system 700 along the continuous path of this example includes: (a) a first strap portion 710*a* extending around a front ankle opening area (FIGS. 7A through 7C), (b) a second strap portion 710*b* extending from the first strap portion 710*a* and along a lateral ankle opening area (FIG. 7A), (c) a third strap portion 710*c* extending from the second strap portion 710*b* and around a rear ankle opening area (FIG. 7E), (d) a fourth strap portion 710*d* extending from the third strap portion 710*c* and along a medial heel area (FIG. 7C), (e) a fifth strap portion 710*e* extending from the fourth strap portion 710*d* and around a medial edge (FIGS. 7C and 7D), (f) a sixth strap portion 710*f* extending from the fifth strap portion 710*e* and across a plantar surface area (FIG. 7D), (g) a seventh strap portion 710*g* extending from the sixth strap portion 710*f* and around a lateral edge area (FIGS. 7A and 7D), (h) an eighth strap portion 710*h* extending from the seventh strap portion 710*g* and across a top area of the upper (FIGS. 7A through 7C), (i) a ninth strap portion 710*i* extending from the eighth strap portion 710*h* and around the medial side area at or near a first metatarsal head area (FIGS. 7A and 7D), (j) a tenth strap portion 710*j* extending from the ninth strap portion 710*i* and beneath the plantar surface area (FIG. 7D), (k) an eleventh strap portion 710*k* extending from the tenth strap portion 710*j* and around the lateral side area at or near the fifth metatarsal head area (FIGS. 7A and 7D), (l) a twelfth strap portion 710*l* extending from the eleventh strap portion 710*k* and across the top area (FIGS. 7A through 7C), (m) a thirteenth strap portion 710*m* extending from the twelfth strap portion 710*l* and around the medial edge area (FIGS. 7C and 7D), (n) a fourteenth strap portion 710*n* extending from the thirteenth strap portion 710*m* and across the plantar surface area (FIG. 7D), (o) a fifteenth strap portion 710*o* extending from the fourteenth strap portion 710*n* and around the lateral edge area (FIGS. 7A and 7D), (p) a sixteenth strap portion 710*p* extending from the fifteenth strap portion 710*o* and along a lateral heel area (FIGS. 7A and 7E), (q) a seventeenth strap portion 710*q* extending from the sixteenth strap portion 710*p* and around the rear ankle opening area (FIG. 7E), and (r) an eighteenth strap portion 710*r* extending from the seventeenth strap portion 710*q* and along the medial ankle opening area. In the example structure illustrated in FIGS. 7A through 7E, the first strap portion 710*a* and the eighteenth strap portion 710*r* are joined to one another via tensioning element 704*a* that constitutes a portion of the means for applying a force to the strap 700*a* (and such that the strap 700*a* traverses a continuous loop around the bootie element 702).

Figure 7A:
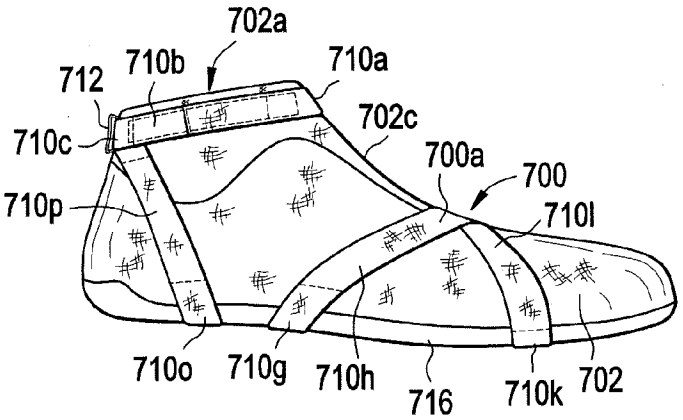
FIGS. 7A through 7E include various views of a strap system according to yet another example of this invention.
Figure 7B:
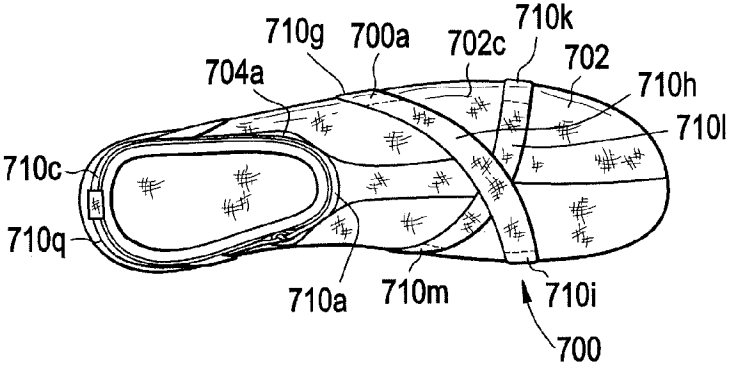
Figure 7C:
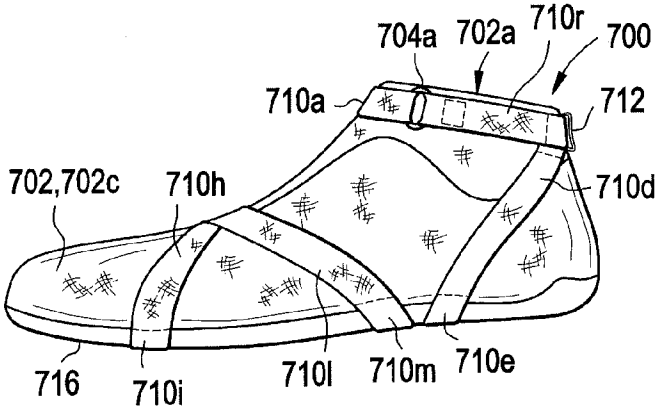
Figure 7D:
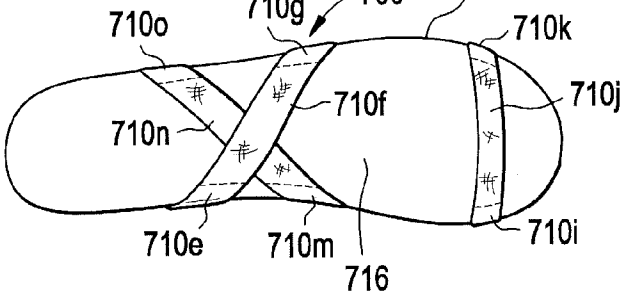
Figure 7E:
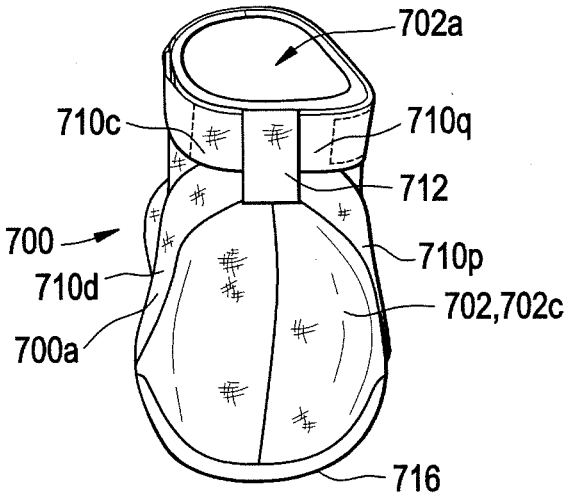

This strap system 700 crosses itself at various locations over the course of its path. As shown in FIG. 7E, the seventeenth strap portion 710*q* crosses the third strap portion 710*c* at the rear heel ankle opening area of the bootie element 702. Notably, in this illustrated example construction, these two portions of the strap member 700*a* cross one another at (or within) a loop element 712 located at the rear ankle area (akin to other rear heel loop elements described above). Also, as shown in FIG. 7B, the twelfth strap portion 710*l* crosses the eighth strap portion 710*h* at the top area of the bootie element 702, in front of the ankle opening or within an instep area or top area of the bootie element 702 (and in the forefoot or midfoot portion of the upper). Additionally, as shown in FIG. 7D, the fourteenth strap portion 710*n* crosses the sixth strap portion 710*f* at the bottom plantar surface of the bootie element 702 in the midfoot or heel area.

The bootie element 702 may be incorporated into an upper for an article of footwear or other foot-receiving device. The bootie element 702 may include a stretchable fabric material around at least a portion of the ankle opening so as to better accommodate insertion of a wearer's foot while still maintaining a good, snug overall fit for the wearer. Alternatively, if desired, the bootie element 702 could be omitted and the strap system 700 could be directly attached to other components of a footwear upper and/or sole structure (e.g., as shown in FIGS. 3A through 3C). Such articles of footwear (with or without a bootie element) may include more conventional lacing systems, if desired.

The bootie element 702 (or other portions of the footwear or foot-receiving device structure) may include one or more loop elements 714 or other strap securing element(s) to engage and/or guide the strap member 700*a*, e.g., like loop elements 202*d* through 202*h* described above). Also, while not shown in FIGS. 7A through 7D, if desired, the strap member 700*a* may include additional strap portions extending toward the footbed 702 and forming a portion of a "heel lock" as illustrated and described above in conjunction with strap portions 404 and 408 in FIGS. 4A through 4D (although the existing strap portions passing alongside and beneath the heel in this example may provide sufficient heel engagement, for at least some uses and/or at least some example structures according to the invention).

A means for applying a force to the one or more strap members so as to shorten a length of the continuous path may be provided at any desired location(s) along the path of strap system 700 shown in FIGS. 7A through 7E. As noted above, such means may include tensioning elements and hook-and-loop type fasteners, buckle type structures, clamp type structures, rotary "take up" mechanisms used to roll in excess strap, ratchet mechanisms, cable tie type securing mechanisms, buttons, snaps, or the like. In the illustrated embodiment, the means for applying force are provided between the first strap portion 710*a* and the eighteenth strap portion 710*r*. Other options also are possible. For example, the free ends of the strap 700*a* could be connected along the lateral side of the bootie element 702 (and include tensioning elements and/or other means for applying force at that location). As another example, if desired, the free ends of the strap 700*a* could be connected at the rear heel area, and an appropriate means for applying force may be provided at that location. As yet additional examples, the free ends of the strap 700*a* could be connected at the location in the instep area where the strap portions cross (e.g., joined by an appropriate means for applying force at that location). Other options for joining the free ends of the strap 700*a* (or independent strap members) may be used without departing from this invention.

The locations of and the dividing lines between the various strap portions described above and shown by the broken lines in FIGS. 7A thru 7E are selected somewhat arbitrarily, e.g., based on the discernible locations with respect to the wearer's foot. These features are provided in the drawings as a visual aide to help explain and describe these features of the invention.

FIGS. 7A through 7E also illustrate features of a bootie member 702 that may be used as at least a portion of an upper for an article of footwear or other foot-receiving device in accordance with examples of this invention. As illustrated in these figures, this example bootie member 702 includes a base bootie component 702*c*, e.g., made of one or more pieces of a soft, comfortable feeling fabric, optionally including stretchable fabric(s) at various locations to facilitate insertion of a wearer's foot through the ankle opening 702*a* (i.e., the foot-receiving opening). The illustrated bootie member 702 further includes a separate footbed component 716 engaged with the base bootie component 702*c*, e.g., by sewing, stitching, adhesives, cements, etc. The footbed component 716 supports the plantar surface of a wearer's foot and may include appropriate curvature or structure to comfortably engage and support a wearer's foot. The footbed component 716 may be somewhat more rigid and strong as compared to the base bootie component 702*c*.

As noted above, the strap system 700 of this example structure crosses at three different locations over the course of the continuous path. In use, the strap system 700 may be initially tightened and secured with the foot in the plantar flexed position. Then, as the user runs (e.g., sprints), the strap system 700 remains tight or tightens as the foot moves from a plantar flexed position as shown in FIG. 1C to a dorsiflexed position, as shown in FIG. 1B.

The strap system 700 construction of FIGS. 7A through 7E may be incorporated into an article of footwear structure, e.g., by engaging the bootie member 702 with a sole structure (e.g., optionally including a midsole element (e.g., foam, fluid-filled bladder, etc.), and outsole element, or the like). In this example of the invention, the engagement between the footbed 716 and the sole components may include a gap, channel, or other sufficient clearance to allow the strap system 700 to move with respect to the other components of the shoe. Also, if desired, some or all portions of the bootie member 702 exterior may be covered by another material, such as synthetic or natural leather, plastic, rubber, TPU, or the like, e.g., to increase the durability, abrasion resistance, and wear resistance of the overall footwear construction. If at least partially covered, the cover material may be positioned and/or engaged with the shoe so as to allow the strap system 700 to move with respect to the other components of the upper. If necessary or desired, the strap system 700 may be coated or otherwise reinforced at appropriate positions to prevent excessive wear or fraying of the individual strap member(s).

In the example structure illustrated in FIGS. 7A through 7E, the strap member 700*a* is engaged with the bootie element 702 in a free floating manner. Alternatively, if desired, portions of the strap system 700 may be fixed, e.g., to the bottom plantar surface of the bootie member 702 or other component of the footwear (or foot-receiving device). In other words, if desired, some portion(s) of the strap member 700*a* (e.g., along the plantar surface) could be omitted (thereby forming multiple straps), and some ends or other portions of the straps could be fixed to the upper in appropriate locations (e.g., at the plantar surface of the bootie member), in a manner akin to the structure(s) shown in FIGS. 6A through 6D), while still achieving the same foot conformance and/or strap wrapping features.

CONCLUSION

Of course, many modifications to the strap systems, bootie members, upper members, articles of footwear, and/or other foot-receiving devices, as well as to the methods for making these structures, may be made without departing from the invention. For example, the joints or junctions between strap members or portions may be provided at a variety of different locations without departing from this invention, and/or other structural elements may be provided and/or modified in the structure without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

The invention claimed is:

1. A strap system engaged with and in combination with an upper for an article of footwear, comprising:

one or more strap members formed or engaged together in a continuous path along the upper, wherein the one or more strap members include:

(a) a first strap portion extending along a lateral ankle opening area of the upper, (b) a second strap portion extending from the first strap portion and across a front ankle opening area of the upper, (c) a third strap portion extending from the second strap portion and around a medial midfoot area of the upper, (d) a fourth strap portion extending from the third strap portion and beneath a plantar support surface area of the upper, (e) a fifth strap portion extending from the fourth strap portion and around a lateral side area of the upper at or near a fifth metatarsal head covering area of the upper, (f) a sixth strap portion extending from the fifth strap portion and across a top forefoot area of the upper, (g) a seventh strap portion extending from the sixth strap portion and around a medial side area of the upper at or near a first metatarsal head covering area of the upper, (h) an eighth strap portion extending from the seventh strap portion and beneath the plantar support surface area of the upper to a lateral midfoot area of the upper, (i) a ninth strap portion extending from the eighth strap portion, around the lateral midfoot area of the upper, and across the front ankle opening area of the upper, and (j) a tenth strap portion extending from the ninth strap portion and along a medial ankle opening area of the upper, and means for applying a force to the one or more strap members so as to shorten a length of the continuous path of the one or more strap members along the upper and thereby apply tension to the one or more strap members.

2. The strap system engaged with and in combination with the upper according to claim 1, wherein the second strap portion is part of a different strap member than a strap member containing the third strap portion, and wherein the second strap portion and the third strap portion are joined to one another via a connecting element.

3. The strap system engaged with and in combination with the upper according to claim 1, wherein the sixth strap portion is part of a different strap member than a strap member containing the seventh strap portion, and wherein the sixth strap portion and the seventh strap portion are joined to one another via a connecting element.

4. The strap system engaged with and in combination with the upper according to claim 1, wherein the second strap portion and the seventh strap portion are provided on a first strap member, and wherein the third strap portion and the sixth strap portion are provided on a second strap member that is separate from the first strap member.

5. The strap system engaged with and in combination with the upper according to claim 4, wherein the second strap portion and the third strap portion are joined to one another via a first tensioning element that constitutes a portion of the means for applying a force, and wherein the sixth strap portion and the seventh strap portion are joined to one another via a second tensioning element that constitutes another portion of the means for applying a force.

6. The strap system engaged with and in combination with the upper according to claim 1, wherein the ninth strap portion crosses the second strap portion.

7. The strap system engaged with and in combination with the upper according to claim 1, wherein the one or more strap members are engaged with the upper in a free floating manner.

8. The strap system engaged with and in combination with the upper according to claim 1, further comprising:

an eleventh strap portion extending from the first strap portion in a direction toward a footbed member of the upper; and a twelfth strap portion extending from the tenth strap portion in a direction toward the footbed member of the upper.

9. The strap system engaged with and in combination with the upper according to claim 8, wherein each of the eleventh strap portion and the twelfth strap portion extends beneath the footbed member of the upper.

10. The strap system engaged with and in combination with the upper according to claim 1, wherein the tenth strap portion is connected with the first strap portion such that the continuous path constitutes a continuous loop around the upper.

11. The strap system engaged with and in combination with the upper according to claim 1, wherein the upper includes a bootie member that at least partially defines a foot-receiving chamber.

12. The strap system engaged with and in combination with the upper according to claim 1, wherein the upper includes an upper bootie portion and a footbed member engaged with the upper bootie portion.

13. An article of footwear, comprising:

a strap system engaged with and in combination with an upper according to claim 1; and a sole member engaged with the upper.

14. The strap system engaged with and in combination with the upper according to claim 1, wherein the one or more strap members forming the continuous path consist of the first strap portion through the tenth strap portion.

15. The strap system engaged with and in combination with the upper according to claim 1, wherein at the top forefoot area of the upper, the sixth strap portion is a forward-most strap portion of the first strap portion through the tenth strap portion that form the continuous path.

16. The strap system engaged with and in combination with the upper according to claim 1, wherein the first strap portion through the tenth strap portion that form the continuous path cross one another a single time beneath the plantar support surface area of the upper.

17. The strap system engaged with and in combination with the upper according to claim 1, wherein the strap portions located beneath the plantar support surface area of the upper extend beneath the plantar support surface area of the upper in a free floating manner.

18. The strap system engaged with and in combination with the upper according to claim 1, wherein the first strap portion through the tenth strap portion that form the continuous path cross one another a single time beneath the plantar support surface area of the upper and a single time above a top surface of the upper.

19. A strap system engaged with and in combination with a foot-covering component for a foot-receiving device, comprising:

a first strap member having a first end and a second end, the first strap member extending continuously from:

a first metatarsal head covering area of the foot-covering component, around a medial side of the foot-covering component and beneath a plantar support surface area of the foot-covering component at the first metatarsal head covering area of the foot-covering component, to a lateral midfoot area of the foot-covering component, around a lateral side of the foot-covering component at the lateral midfoot area of the foot-covering component, across a front instep covering area of the foot-covering component, around a medial ankle opening area of the foot-covering component, around a rear ankle opening area of the foot-covering component, along a lateral ankle opening area of the foot-covering component, and across the front instep covering area of the foot-covering component; and a second strap member having a first end and a second end, the second strap member extending continuously from:

a medial midfoot area of the foot-covering component, around the medial side of the foot-covering component and beneath the plantar support surface area of the foot-covering component at the medial midfoot area of the foot-covering component, to a fifth metatarsal head covering area of the foot-covering component, around the lateral side of the foot-covering component at the fifth metatarsal head covering area of the foot-covering component, across a top forefoot area of the foot-covering component, and toward the first metatarsal head covering area of the foot-covering component, wherein the first end of the first strap member engages the second strap member at a first location at the first metatarsal head covering area of the foot-covering component, and wherein the first strap member engages the first end of the second strap member at a second location at the medial midfoot area of the foot-covering component.

20. The strap system engaged with and in combination with the foot-covering component according to claim 19, wherein the first strap member crosses the second strap member beneath the plantar support surface area of the foot-covering component.

21. The strap system engaged with and in combination with the foot-covering component according to claim 20, wherein the first strap member crosses itself in front of the ankle opening area of the foot-covering component.

22. The strap system engaged with and in combination with the foot-covering component according to claim 19, wherein the first strap member crosses itself in front of the ankle opening area of the foot-covering component.

23. The strap system engaged with and in combination with the foot-covering component according to claim 19, wherein the second end of the first strap member includes a portion of a first strap securing system, and wherein the second end of the second strap member includes a portion of a second strap securing system.

24. The strap system engaged with and in combination with the foot-covering component according to claim 19, further comprising:

a first ankle securing strap portion extending from the first strap member at a medial ankle portion of the first strap member and toward the plantar support surface area of the foot-covering component; and a second ankle securing strap portion extending from the first strap member at a lateral ankle portion of the first strap member and toward the plantar support surface area of the foot-covering component.

25. The strap system engaged with and in combination with the foot-covering component according to claim 24, wherein each of the first ankle securing strap portion and the second ankle securing strap portion extends beneath the plantar support surface area of the foot-covering component.

26. The strap system engaged with and in combination with the foot-covering component according to claim 19, wherein only the second strap member extends across the top forefoot area of the foot-covering component.

27. The strap system engaged with and in combination with the foot-covering component according to claim 19, wherein the first strap member crosses the second strap member a single time beneath the plantar support surface area of the foot-covering component.

28. The strap system engaged with and in combination with the foot-covering component according to claim 19, wherein the first strap member and the second strap member extend beneath the plantar support surface area of the foot-covering component in a free floating manner.

29. A strap system engaged with and in combination with an upper for an article of footwear, comprising:

one or more strap members formed or engaged together in a continuous path along the upper, wherein the one or more strap members include:

(a) a first strap portion extending along a lateral ankle opening area of the upper, (b) a second strap portion extending from the first strap portion and across a front ankle opening area of the upper, (c) a third strap portion extending from the second strap portion and around a medial midfoot area of the upper, (d) a fourth strap portion extending from the third strap portion and beneath a plantar support surface area of the upper, (e) a fifth strap portion extending from the fourth strap portion and around a lateral side area of the upper at or near a fifth metatarsal head covering area of the upper, (f) a sixth strap portion extending from the fifth strap portion and across a top forefoot area of the upper, (g) a seventh strap portion extending from the sixth strap portion and around a medial side area of the upper at or near a first metatarsal head covering area of the upper, (h) an eighth strap portion extending from the seventh strap portion and beneath the plantar support surface area of the upper to a lateral midfoot area of the upper, (i) a ninth strap portion extending from the eighth strap portion, around the lateral midfoot area of the upper, and across the front ankle opening area of the upper, and (j) a tenth strap portion extending from the ninth strap portion and along a medial ankle opening area of the upper, and a tensioning element through which a tensile force is applied to the one or more strap members so as to shorten a length of the continuous path of the one or more strap members along the upper; and a securing system for securing the one or more straps with the tensile force applied thereto.

* * * * *